United States Patent [19]

Harris et al.

[11] 4,044,844

[45] Aug. 30, 1977

[54] IMPACT DRILLING TOOL

[75] Inventors: Jesse W. Harris; Ross Bassinger; Grey Bassinger, all of San Antonio, Tex.

[73] Assignee: Bassinger Tool Enterprises, Ltd., San Antonio, Tex.

[21] Appl. No.: 706,678

[22] Filed: July 19, 1976

Related U.S. Application Data

[63] Continuation-in-part of Ser. No. 479,369, June 14, 1974, Pat. No. 3,970,152.

[51] Int. Cl.[2] ..... E21B 1/06

[52] U.S. Cl. ..... 173/73; 91/50; 175/92

[58] Field of Search ..... 91/50; 173/15, 67, 73; 175/92, 296

[56] References Cited

U.S. PATENT DOCUMENTS

| | | | |
|---|---|---|---|
| 1,892,517 | 12/1932 | Pennington | 175/65 |
| 2,620,162 | 12/1952 | Pennington | 173/73 |
| 2,943,603 | 7/1960 | Bassinger | 91/50 X |
| 3,162,251 | 12/1964 | Bassinger | 173/73 |
| 3,768,576 | 10/1973 | Martini | 173/73 |

*Primary Examiner*—Ernest R. Purser

[57] ABSTRACT

A fluid operated impact drilling tool has a hammer slidably mounted in a casing connected to a string of drilling pipe. Inside the casing above the hammer is mounted a valve. Both the valve and hammer have reciprocal sliding movement along the longitudinal axis of the tool to substantially interrupt flow of a drilling fluid therethrough. Movement of the valve and hammer predominantly results from different pressures acting on separate pressure areas of the valve and hammer. The hammer may impact either an anvil or a bit attached thereto. Wear on the valve and hammer is reduced by smooth, hardened surfaces at locations subject to wear. A trapped fluid may also be used in an alternative embodiment to dampen the shock effect of the valve as it reaches its upper and lower stops.

10 Claims, 9 Drawing Figures

IMPACT DRILLING TOOL

This application is a continuation-in-part of U.S. Patent Application Ser. No. 479,369 now U.S. Pat. No. 3,970,152 filed on June 14, 1974 by the same inventors herein, herein after called the "parent application".

BACKGROUND OF THE INVENTION

This invention relates to a fluid actuated impact drilling tool, and more particularly, to an impact drilling tool that can be used in the petroleum drilling industry and actuated by an hydraulic fluid, normally the drilling mud. Since the filing of parent application 479,369, changes and improvements have been made in the original invention as a result of extensive field testing. This patent application is directed towards the patentable improvements.

DESCRIPTION OF THE PRIOR ART

A summary of the prior art is contained in the parent application, which summary is hereby incorporated by a reference in the present application. Since the filing of the parent application, there has been no further prior art known to the inventors that would significantly add to the summary as contained in the parent application.

SUMMARY OF THE INVENTION

While the parent application was described in conjunction with a hammer-anvil configuration, additional testing has shown that the anvil can be eliminated with the hammer extending from the lower end of the casing and having a bit attached to the end thereof. The hammer impacts the drill bit against the bottom of the hole being drilled. This particular configuration is commonly referred to as a churn-type of impact drilling device.

The casing for the impact drilling tool has an upper sub for connection into a string of drilling pipe. The lower portion of the impact drilling tool has a spline connection for allowing reciprocal movement from the bottom of the impact drilling tool. The hammer, which may or may not include the anvil, is reciprocally mounted inside the casing and has a fluid flow path therethrough. A poppet valve is located above the hammer. Fluid pressure outside the impact drilling tool connects to a pressure surface defined by a seal area of the poppet valve and to a pressure surface defined by seal areas of the hammer. During operation of the impact drilling tool, pressure outside the impact drilling tool is less than fluid pressure being fed into the impact drilling tool due to a pressure drop across the drill bit.

During normal drilling operations, a drilling fluid will flow into the impact drilling tool with the pressure of drilling fluid on pressure surfaces causing the poppet valve and the hammer to move upward. Since the poppet valve is much lighter than the hammer, and because of the design of its pressure surfaces, it will move to its uppermost position at a much faster rate than the hammer. As the hammer moves upward, at a predetermined point the poppet valve will suddenly move downward or "dive" into an opening in the hammer thereby substantially interrupting fluid flow therethrough. Since the pressure below the poppet valve and hammer is now very low, but is very high above the poppet valve and hammer, the hammer will reverse direction and move downward at a high velocity. As the hammer moves downward immediately prior to impact, it will separate from the poppet valve. This allows the pressure above the poppet valve to feed below the poppet valve thereby causing the poppet valve to return to its uppermost position. Upward movement of the poppet valve is also caused from a decrease in pressure above the poppet valve, as well as the increase in pressure below the poppet valve, due to a resumption of a fluid flow. Rapid movement of the poppet valve is impeded by a dampening fluid acting against the poppet valve.

The ratios of various pressures times surface areas of the poppet valve and the hammer become very critical. Unless the poppet valve has a tendency to move downward into the hammer, thereby substantially interrupting fluid flow, before the hammer reaches a stable position as determined by the pressures times pressure areas, an equilibrium condition may result. This pressure-area balance will be discussed in the description of the preferred embodiment.

DESCRIPTION OF THE PREFERRED EMBODIMENT

Figure 1A:
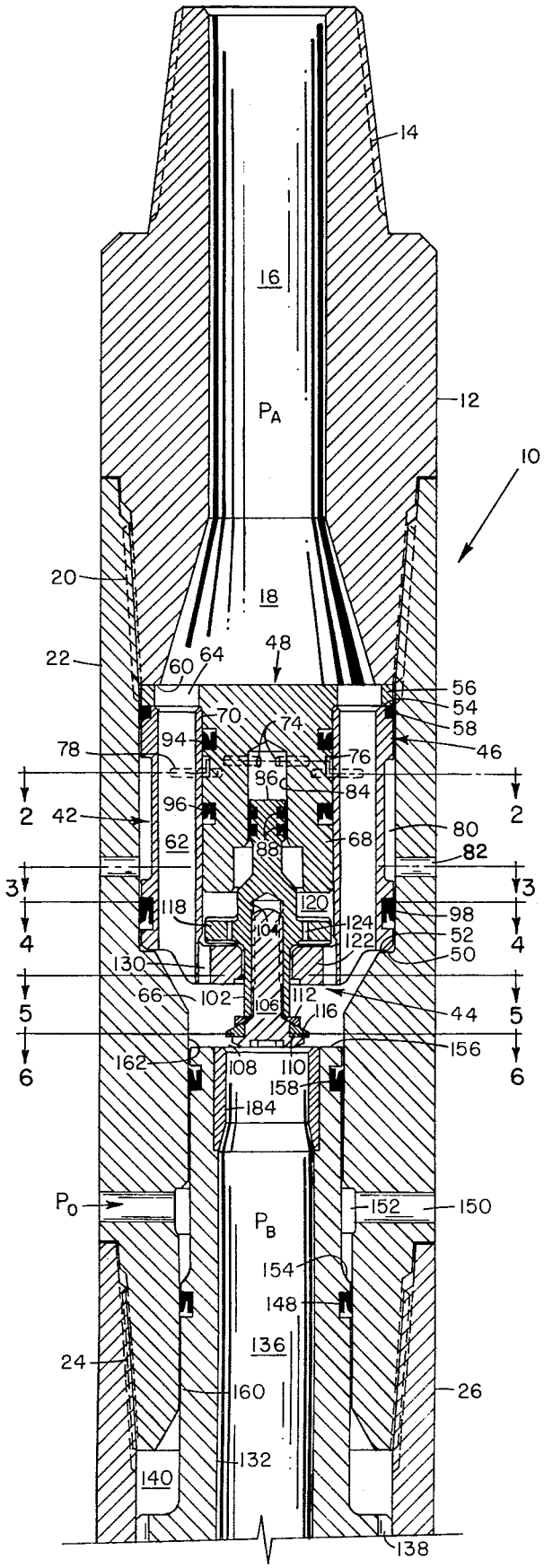
FIGS. 1*a* and 1*b* are elevated cross sectional views of an impact drilling tcol.
Figure 1B:
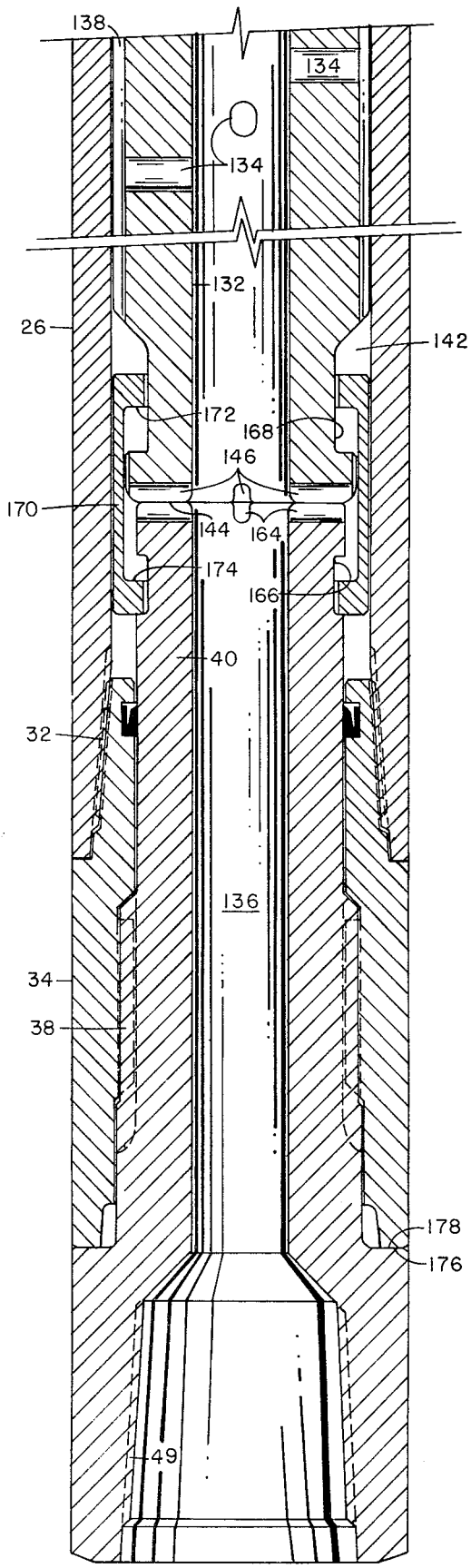

Referring now to FIGS. 1*a* and 1*b* of the drawings, there is shown an impact drilling tool represented generally by the reference numeral 10. The impact drilling tool 10 has an upper sub 12 for connection to a string of drilling pipe (not shown) by means of threads 14. A center flow passage 16 of the upper sub 12 receives drilling fluid via the string of drilling pipe (not shown). The center flow passage 16 has an outward taper 18 at the lower portion thereof.

The lower end of upper sub 12 is connected by threads 20 to a mid sub 22. The lower end of the mid sub 22 is connected by means of threads 24 to hammer case 26.

The lower end of hammer case 26 is connected by means of threads 32 to drive sub 34. Drive sub 34 comprises an anvil housing which has a spline connection 38 to anvil 40. The lower portion of anvil 40 is provided with threads 49 for connection to a drill bit or other device (not shown). The upper sub 12, mid sub 22, hammer case 26 and drive sub 34 comprises the tool housing.

The mid sub 22 encloses a valve cartridge assembly 42 consisting of a flow structure 46, a poppet valve 44 and a valve retainer 48. The poppet valve 44 is slidably contained within the flow structure 46 and consists of a head portion 86, a flange portion 118, and a lower portion 102 having a threaded center bore 104 for receiving a threaded bolt 106 therein for retaining hardened ring 110 and beveled washer 112 thereon. Upon tightening bolt 106 into center bore 104, beveled washer 112 is pressed against the bottom of lower portion 102. In turn, the beveled washer 112 presses against the tapered surface 116 of hardened ring 110 to securely hold it in position against the head of bolt 106. While the hardened ring 110 may be made from any suitable substance, applicants have found tungsten carbide to be particularly desirable to prevent excessive wear.

The lower end 50 of the flow structure 46 rests against shoulder 52 of the mid sub 22. The upper end 54 of the flow structure 46 abuts flange 56 of valve retainer 48 with seal 58 located therebetween. Upon tightening upper sub 12 into position, its lower end 60 presses against flange 56 thereby holding retainer 48 and flow structure 46 securely in position.

Figure 2:
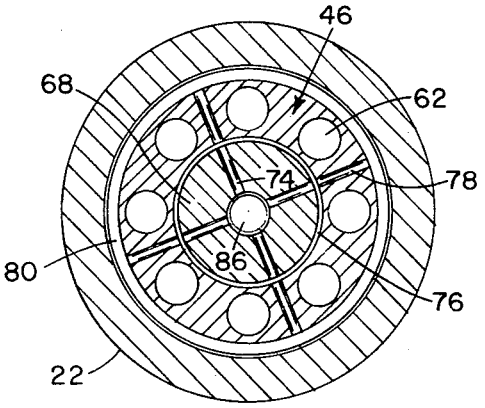
FIG. 2 is a cross sectional view of FIG. 1*a* along section lines 2—2.
Figure 3:
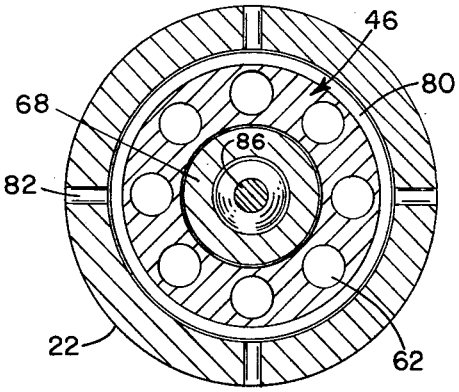
FIG. 3 is a cross sectional view of FIG. 1*a* along section lines 3—3.
Figure 4:
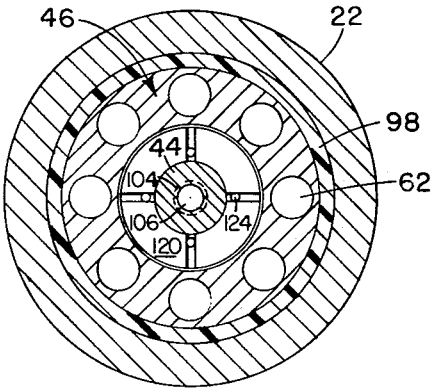
FIG. 4 is a cross sectional view of FIG. 1*a* along section lines 4—4.
Figure 5:
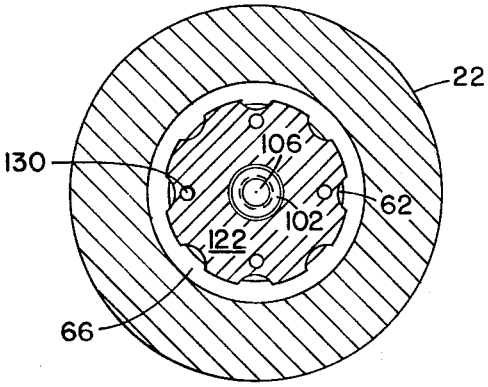
FIG. 5 is a cross sectional view of FIG. 1*a* along section lines 5—5.
Figure 6:
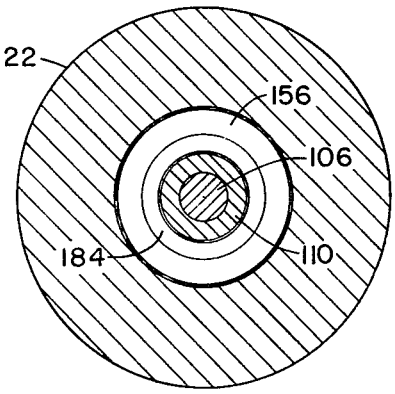
FIG. 6 is a cross sectional view of FIG. 1*a* along section lines 6—6.

Flow structure 46 has a series of longitudinal holes 62 extending therethrough which are aligned with holes 64 in flange 56 to allow free communication of drilling fluid from center flow passage 16 of upper sub 12 to cavity 66 below flow structure 46. The cross sectional views of FIGS. 2, 3 and 4, depict eight longitudinal holes typically represented by numeral 62 through the flow structure 46, however, this number may be varied according to the flow requirements of the particular impact drilling tool.

The retainer 48 has a downwardly extending circular portion 68 received in central opening 70 of flow structure 46. The downwardly extending circular portion 68 of retainer 48 has a series of cross passages 74 extending from a center bore 84 to an undercut annulus 76 (See FIG. 2). The cross passages 74 connect to the uppermost portion of undercut annulus 76. Cross passages 78 (which do not intersect longitudinal bores 62) connect the bottom of undercut annulus 76 to the upper portion of flow structure annulus 80. The bottom of flow structure annulus 80 is connected by means of openings 82 to the outside of mid sub 22 (See FIG. 3). For a better understanding of the cross passages 74 and 78 which connect undercut annulus 76 and flow structure annulus 80, refer to the cross sectional views shown in FIGS. 2 and 3, as well as FIG. 1.

The head portion 86 of poppet valve 44 is slidably received in the bore 84 of retainer 48. The head portion 86 is slidably sealed by means of seals 88. Upper retainer seal 94 and lower retainer seal 96 prevent any leakage of pressurized fluid between the flow structure 46 and retainer 48. Outer seal 98, along with seal 58, prevents any leakage of pressurized fluid between flow structure 46 and mid sub 22.

The flange portion 118 is located in chamber 120 formed between retainer 48 and inward flanged seat 122 of flow structure 46. While there is a predetermined tolerance between the flange portion 118 and central opening 70 of flow structure 46 to allow leakage therearound, additional leakage bores 124 are contained therethrough. Below flange 118, a series of holes 130 extend through the inward flange seat 122 and connect chamber 120 with cavity 66 to equalize pressure therebetween.

The hammer 132 telescopically mounted inside of hammer case 26 is essentially the same as the hammer described in the parent application. A series of slotted cross bores 134 connect a center flow passage 136 to longitudinal outer slots 138. The longitudinal outer slots 138 connect the pressurized fluid inside of center flow passage 136 to annulus 140 and annulus 142. The pressure inside of center flow passage 136 acts on the entire hammer face 144 by means of cross slots 146.

A variable opening 108 between the ring 110 on poppet valve 44 and a sleeve 184 at the upper end of flow passage 136 separates the tool into two zones of pressure, $P_A$ above the opening and $P_B$ below the opening. The resultant upward force on hammer 132 is equal to the area sealed by seal 148, minus the area of the center flow passage 136, times the pressure $P_B$ in the center flow passage 136.

Pressure outside the impact drilling tool 10, hereinafter referred to as $P_O$, feeds to the side of seal 148 opposite pressure $P_B$ in annulus 140 via openings 150 in mid sub 22 and annulus 152. The pressure $P_O$ inside annulus 152 acts against an area defined by shoulder 154 of hammer 132 to give a downward force on the hammer 132.

The pressure $P_A$ that exists in center flow passage 16 of upper sub 12 also exists in cavity 66 to act on the upper surface 156 of hammer 132. Seal 158 prevents leakage between the outside pressure $P_O$ and the upper pressure $P_A$. Likewise, seal 148 prevents leakage between the lower pressure $P_B$ and the outside pressure $P_O$. Seals 148 and 158 slidably seal against inside surfaces 160 and 162, respectively of mid sub 22.

The top of anvil 40 has a series of cross slots 164 to prevent the drilling fluid from being trapped between anvil 40 and hammer 132. There is an external undercut 166 below the top of the anvil 40, as well as an external undercut 168 immediately above the hammer face 144 of the hammer 132. A split ring 170, which is divided into two half-cylinders has an inward upper flange 172 located in external groove 168 and an inward lower flange 174 in external groove 166. The split ring 170 acts as an anvil catcher thereby preventing anvil 40 from dropping from the lower end of anvil housing 34. Upon lifting the drilling tool 10 off the bottom of the hole, the anvil 40 will drop downward. The split ring 170 will hold the hammer 132 down thereby preventing reciprocating action of the hammer 132. During normal drilling action, the lower end 176 of anvil housing 34 rests against shoulder 178 of anvil 40 to hold the bit down with a predetermined downweight.

METHOD OF OPERATION

The impact drilling tool 10 is normally connected immediately above a bit in a string of drilling pipe used in petroleum drilling with a drilling fluid commonly called "drilling mud". The drilling fluid is pumped through the string of drilling pipe into a center flow passage 16 of upper sub 12. From center flow passage 16, the drilling fluid flows through longitudinal holes 62 ahnd cavity 66 into center flow passage 136 of hammer 132.

The pressure $P_A$ acts on upper surface 156 and pressure $P_O$ acts on shoulder 154 of hammer 132 thereby tending to force the hammer down. Pressure $P_B$ acts against the bottom of the hammer 132 defined by seal 148 thereby tending to force the hammer 132 up. During initial flow of the drilling fluid, to poppet valve 44 is "open" and there is no substantial difference between $P_A$ and $P_B$; therefore, forces on the area defined by seal 158 of hammer 132 will cancel. However, since $P_O$ is less than $P_B$, and both are acting on opposite sides of the area defined by shoulder 154, there will be a tendency to move the hammer 132 upward until the hardened ring 110 interrupts fluid flow. The pressure times the respective pressure surfaces are modified by the weight of the hammer 132, viscous drag and seal friction but such factors are small with respect to the respective pressures times pressure areas.

$P_A$ acts against the bottom of the poppet valve 44, more particularly the pressure area defined by seals 88, to move the poppet valve 44 upward because the pressure $P_O$ acting against the top of head 86 also defined by seals 88 is less than $P_A$ as defined by the pressure drop across the bit. Since $P_B$ is substantially equal to $P_A$ during initial flow of the drilling fluid, pressure acting on the upper and lower sides of hardened ring 110 will cancel. However, once the hardened ring 110 starts to interrupt fluid flow, $P_B$ will drop below $P_A$ with the pressure $P_A$ acting against the upper surface of hardened ring 110 thereby forcing the poppet valve 44 downward. The flange 118 is used to dampen the rapid movement of the poppet valve 44 thereby preventing shock forces that would damage the valving mechanism.

Since the poppet valve 44 is much lighter than the hammer 132, it outruns the hammer 132 to its physical limit and waits for the hammer to catch up thereby initiating the next phase of the cycle. When the poppet valve 44 is resting at its lower limit, the hammer 132 continues to move downward beyond hardened ring 110 to enlarge opening 108 before striking the anvil 40.

When the variable opening 108 is in its minimum state ($P_A$ much larger than $P_B$), downward movement of poppet valve 44 and hammer 132 results. Since the same pressures ($P_A$ and $P_B$) are utilized to move both the hammer 132 and the poppet valve 44, the ratio of surface areas acted upon by the pressures ($P_A$ and $P_B$) may be adjusted so that either the poppet valve 44 or the hammer 132 has a greater tendency to move downward. It is essential to a reliable operation of the tool 10 that the poppet valve 44 have downward net force thereon at all operational values of $P_A$ and $P_B$ which could result in a balanced condition (all upward forces equal all downward forces) on the hammer 132.

ALTERNATIVE EMBODIMENT

Referring now to FIGS. *7a* and *7b* of the drawings, there is shown an alternative embodiment of the impact drilling tool represented generally by the reference numeral 210. All numbers previously used in conjunction with the description of the preferred embodiment will be the same where appropriate except increased by the number 200. In this alternative embodiment, only more important reference numerals will be used if the same element was defined in the preferred embodiment.

The poppet valve 244 for impact drilling tool 210 is similar to the preferred embodiment as previously described except that a trapped fluid is now contained in chamber 320. The previously described flow structure 46 now identified as 246 has been modified by the elimination of holes 130, and the flow structure annulus 80 modified to give the present flow structure annulus 280. The flow structure annulus 280 has a floating seal 281 with a trapped fluid (normally a lubricant such as oil) located thereabove. The outside pressure $P_O$ acts against the lower surface of the floating seal 281 so that the outside pressure $P_O$ is applied below seals 288 of poppet valve 244. The pressure $P_A$ acts against the upper surface 287 of the head portion 286. The flange 318 acts in the same manner as previously described except the trapped fluid above floating seal 281 is the only fluid now in contact with flange 318. Added in this alternative embodiment are seals 386 on the lower portion 302 of the poppet valve 244 and the inward flange seat 322. In the alternative embodiment, the head 286 has a long shank to allow the trapped fluid to feed below seals 288 rather than thereabove as was previously the case.

The retainer 248 has been modified over the prior retainer 48 by inclusion of a center bore 388 therethrough.

Figure 7A:
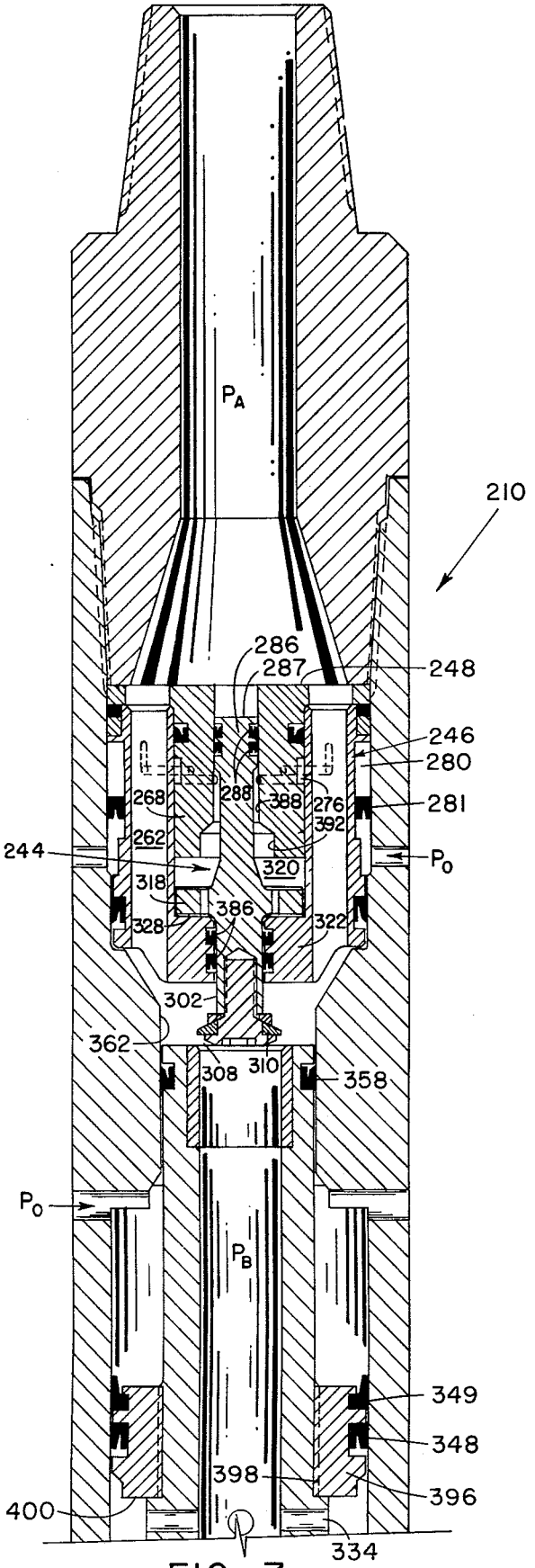
FIGS. 7*a* and 7*b* are elevated cross sectional views of an alternative embodiment of an impact drilling tool.
Figure 7B:
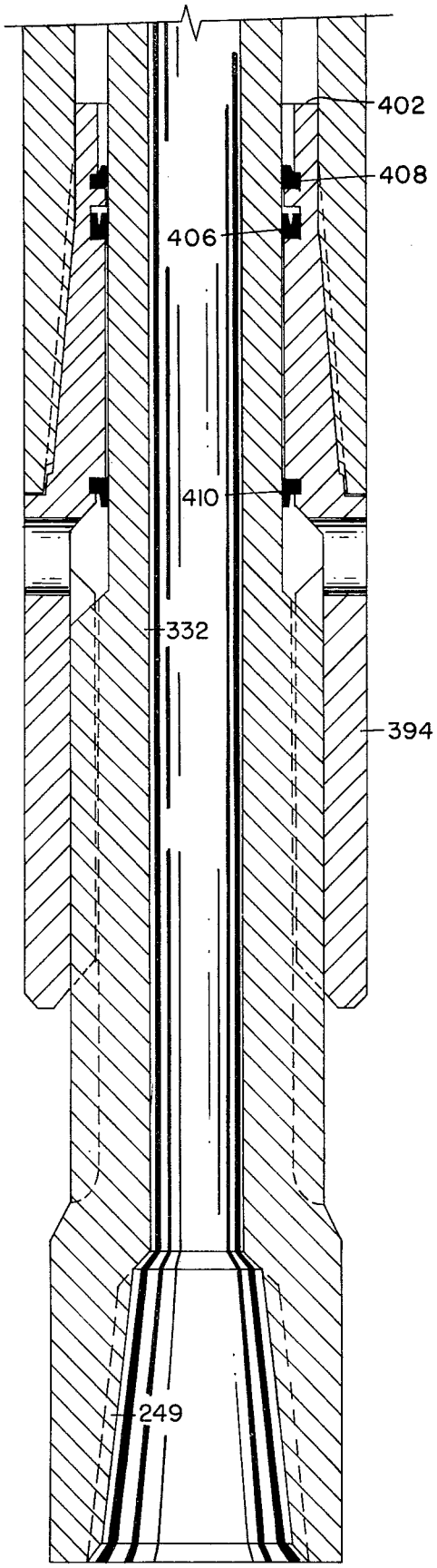

In the alternative embodiment, the forces acting on the poppet valve 244 are (1) the pressure $P_A$ acting on the upper surface 287 of the head portion 286, (2) $P_O$ times the increased area defined between seals 288 and seals 386, (3) the pressure $P_A$ acting on the area defined between seals 386 and hardened ring 310, and (4) the pressure $P_B$ acting on the bottom of the area defined by hardened ring 310. During initial flow of fluid, because $P_B$ is substantially equal to $P_A$ and $P_B$ is greater than $P_O$, poppet valve 244 will immediately move to its uppermost position. When the rise of piston 332 interrupts flow so that $P_B$ is substantially reduced, the poppet valve 244 will move to its lowermost position as shown in FIGS. 7a and 7b.

Referring now to the lower portion of the impact drilling tool 210, the anvil 40 as described in the preferred embodiment has been eliminated so that the piston 332 now receives the bit in thread 249. The anvil housing 34 has been eliminated and replaced with lower sub 394. The previously described shoulder 154 on the preferred embodiment is now formed by a sleeve 396 threadably connected to piston 332 by means of threads 398. The previously described seals 158 and 148 are now seals 358 and 348, respectively. The seals 348 have a wiper 349 to prevent abrasive material from the drilling fluid from damaging the seals.

When lifting the impact drilling tool 210 off the bottom of the hole, if no fluid is flowing through the tool, the piston 332 will move downward due to gravity until the lower end 400 of sleeve 396 rests against the top 402 of lower sub 394. When fluid flow is established, it causes a pressure drop across the bit (not shown). The piston 332 and poppet valve 244 will both rise, as was the case in the preferred embodiment. The alternative embodiment does not require an anvil catcher to stop action when lifting the impact drilling tool 210 off the bottom because there is no destructive metal-to-metal contact when running off bottom. The alternative embodiment has enough downward travel distance after the piston 332 leaves the poppet valve 244 for the energy of the piston to dissipate and the piston 332 to rise again without contact.

The piston 332 as shown in FIGS. *7a* and *7b* wherein the hammer and anvil are combined is commonly referred to as a "churn-type" impact drilling device. The method of operation for the preferred embodiment applies with respect to the movement of piston 332 except that the upward force on the piston 332 created by fluid pressure is equal to the pressure drop across the bit times the area defined by seals 348 minus the area defined by seal 406 and downward force is equal to $P_A$ times the area defined by seal 358 minus the area of the ring 310. Seal 406 is protected from abrasive substances by wipers 408 and 410. When flow through center flow passage 336 has been substantially interrupted so that $P_B$ becomes substantially less than $P_A$, the piston 332 will be driven downward to impact the bit against the bottom of the hole. Otherwise, the operation of the churn-type impact drilling tool 210 is basically the same as the operation of the preferred embodiment previously described.

We claim:

1. A fluid actuated impact drilling tool for use in rotary drilling in a string of drilling pipe comprising:

housing means;

means for connecting said housing means to said string of drilling pipe;

flow means through said housing means for allowing a fluid to flow therethrough;

valve means slidably mounted in said flow means of said housing means;

hammer means slidably mounted in said flow means of said housing means, said valve means and said hammer means moving independently of and relative to each other for periodically interrupting substantial flow of said fluid in said flow means by a first movement along an axis of said drilling tool when said valve means and said hammer means reach a predetermined plane perpendicular to said axis, said interruption of flow of said fluid causing an increase in pressure of said fluid above said plane and a decrease in pressure of said fluid below said plane, said respective increase and decrease in pressures of said fluid driving said valve means and hammer means in a direction opposite the first direction of movement along said axis;

means for communicating pressure outside said housing means to said valve means and said hammer means, said outside pressure being less than pressure of said fluid received by said flow means thereby giving a pressure differential, said first movement of said valve means and said hammer means being caused by said pressure differential acting on given surfaces of said valve means and hammer means as defined by seal means, movement in said opposite direction being caused by said increase and decrease in pressures above and below said plane, respectively, acting on said surfaces;

said movement of said valve means between predetermined stops, said valve means having dampening means for preventing impact damage to said valving means.

2. The apparatus of claim 1 wherein said dampening means includes restricted flow means for allowing limited flow from one side of said valve means to an opposite side of said valve means during movement of said valve means.

3. The apparatus of claim 2 wherein said dampening means includes a chamber having fluid contained therein, extension means from said valve means being located in said chamber and moveable with said valve means, said extension means having restricted flow paths to impede movement of said valve means.

4. The apparatus of claim 3 wherein said fluid in said chamber of said dampening means is trapped by floating seal means receiving said pressure from outside said mid sub.

5. The apparatus of claim 1 wherein hardened insert means are provided at points of said tool subject to fluid wash.

6. The apparatus of claim 5 wherein said points subject to fluid wash include contiguous parts of said valve means and hammer means, hardened insert means also being contiguous with said seal means.

7. The apparatus of claim 6 wherein said hammer means is heat treated to harden its outer surface.

8. A fluid actuated impact drilling tool for use in rotary drilling comprising:

tubular housing means having a means for connecting into a string of drilling pipe, said tubular housing means having a flow passage therethrough to allow flow of drilling fluid;

restriction means below said tool to cause a pressure differential between the inside and outside of said tubular housing means with said inside being of a greater pressure during flow of drilling fluid;

valve means slidable along axis of and contiguous with said tubular housing means between an upper and lower stop position, said sliding movement of said valve means being caused by pressures exerted against valve surfaces of different sizes, said pressure differential existing across valve seal means defining at least one of said valve surfaces;

hammering means slidable along said axis of and contiguous with said tubular housing means, said sliding movement of said hammering means being caused by said pressures being exerted against hammer surfaces, at least one of said hammer surfaces being defined by hammer seal means with said pressure differential being thereacross;

said valve means and said hammering means periodically interrupting substantial flow of said drilling fluid through said flow passage by overlapping of said sliding movement thereof, said valve means having a net downward force thereon when at said upper stop position and before said hammer means reaches a stable position during its upward movement;

said interruption of substantial flow of said drilling fluid causing a backpressure to drive said valve means and hammer means downward by acting against at least one of said valve surfaces and at least one of said hammer surfaces.

9. The fluid actuated impact drilling tool as given in claim 8 wherein said hammer means is a churn-type extending from said tubular housing means with a drill bit attached thereto.

10. The fluid actuated impact drilling tool as given in claim 8 wherein said valve means is a poppet-type valve slidably received in a bore through said hammering means, said bore forming part of said flow passage.

* * * * *